US006966138B1

(12) United States Patent
Deckard

(10) Patent No.: US 6,966,138 B1
(45) Date of Patent: Nov. 22, 2005

(54) DOUBLE FIRE ATTACHMENT AND METHOD FOR SEMI-AUTOMATIC FIREARMS

(76) Inventor: Christopher David Deckard, 305 Due East Ave., New Smyrna Beach, FL (US) 32169

( * ) Notice: Subject to any disclaimer, the term of this patent is extended or adjusted under 35 U.S.C. 154(b) by 82 days.

(21) Appl. No.: 10/768,290

(22) Filed: Jan. 30, 2004

(51) Int. Cl.[7] ..... F41A 19/00
(52) U.S. Cl. ..... 42/69.01; 89/139; 89/143; 89/27.11
(58) Field of Search ..... 42/69.01; 89/139, 89/143, 27.11

(56) References Cited

U.S. PATENT DOCUMENTS

| | | | | | |
|---|---|---|---|---|---|
| 2,986,073 | A | * | 5/1961 | Godar | 89/27.11 |
| 3,142,227 | A | | 7/1964 | Stringer | 89/136 |
| 3,184,875 | A | | 5/1965 | Klebe | 42/69 |
| 4,344,351 | A | | 8/1982 | McQueen | 89/129 |
| 4,514,923 | A | * | 5/1985 | Teel | 42/69.01 |
| 4,685,379 | A | * | 8/1987 | Troncoso | 89/136 |
| 4,787,288 | A | | 11/1988 | Miller | 89/27.3 |
| 4,803,910 | A | * | 2/1989 | Troncoso | 89/27.3 |
| 5,074,190 | A | | 12/1991 | Troncoso | 89/136 |
| D335,519 | S | | 5/1993 | Tripp | D22/108 |
| D371,591 | S | | 7/1996 | Lenkarski et al. | D22/108 |
| 5,890,479 | A | * | 4/1999 | Morin | 124/31 |
| 6,101,918 | A | * | 8/2000 | Akins | 89/129.01 |
| D462,105 | S | | 8/2002 | Myers | D22/108 |

* cited by examiner

*Primary Examiner*—J. Woodrow Eldred
(74) *Attorney, Agent, or Firm*—Brian S. Steinberger; Law Offices of Brian S. Steinberger, P.A.

(57) ABSTRACT

Devices and methods of converting semi-automatic firearms to a double-fire mode where a firearm fires a shot upon a single pull of a trigger, and fires a second shot upon a release of the trigger. A clip attachment can be constructed from a single component shaped to fit and mount onto the trigger and extend to protrude between and separate the foot of the safety-sear from the top of the trigger plate affecting the distance between the hammer engaging notch of the safety-sear and the hammer engaging notch of the trigger-sear which allows the firearm to discharge upon release of the trigger. Another version has a spacer pre-built onto a bottom portion of the pivotal safety sear.

19 Claims, 13 Drawing Sheets

Fig.3
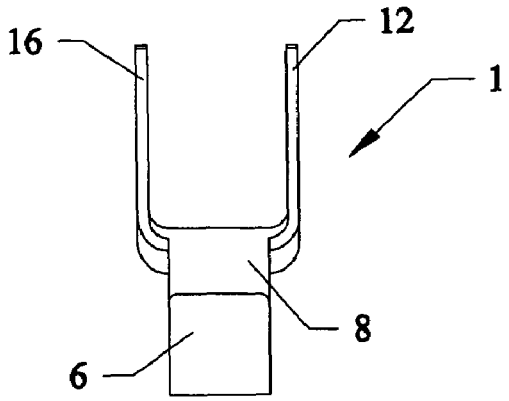
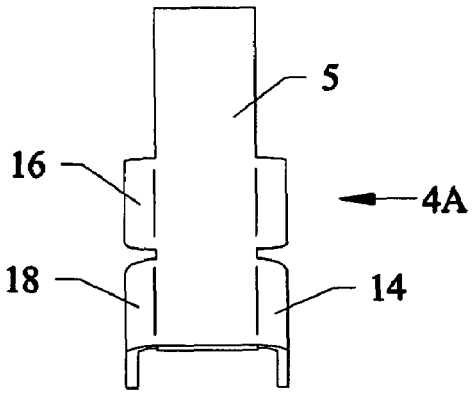
Fig.2
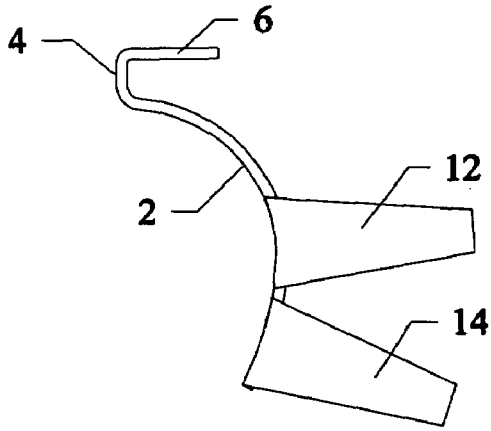
Fig.4

DOUBLE FIRE ATTACHMENT AND METHOD FOR SEMI-AUTOMATIC FIREARMS

FIELD OF INVENTION

This invention relates to firearms, and in particular to retrofit devices and methods and pre-built devices and methods for increasing the firing rate of semi-automatic firearms, such as but not limited to AK type rifles, to a double-fire mode where two shots are fired with a single pull and release of a trigger.

BACKGROUND AND PRIOR ART

Semi-automatic firearms have a limited firing rate which does not approach the firing rate of automatic firearms. Automatic firearms are also known to be more expensive and harder to acquire than semi-automatic firearms. As a result, many devices have been proposed over the years for increasing the firing rate of semi-automatic firearms. See for example, U.S. Pat. No.: 3,184,875 to Klebe; U.S. Pat. No. 4,344,351 to McQueen; U.S. Pat. No. 4,787,288 to Miller; and U.S. Pat. Nos. 4,803,910 and 5,074,190 both to Troncoso.

However, these devices require multiple components and extra tools such as screwdrivers, wrenches and pliers, and the like, that require extra fasteners such as screws, and the like. The prior art converter devices must then be carefully assembled and can take excessive amounts of time for proper assembly in order to work. Some of these converter devices further require extensive modifications such as opening up and/or drilling into the existing firearms that can damage the firearms. Thus, all of these prior art converter devices are generally inconvenient to attach, difficult to operate and control properly, as well as potentially unreliable. Furthermore, once attached these devices can also prevent the firearms from firing at rates other than that which they were meant to operate since the converter attachment can become a fixed addition that is difficult to remove.

Still furthermore, the above devices only convert firearms to a full-automatic mode. Full-automatic firearms are generally considered to be a NFA Class 3 firearm that is typically only available to law enforcement, and not to average consumers.

Thus, the need exists for solutions to the above problems with the prior art.

SUMMARY OF THE INVENTION

A primary objective of the invention is to convert firearms to a double-fire mode where two shots can occur after a single pull and single release of a trigger.

A second objective of the present invention is to provide an attachment device and method for converting semi-automatic firearms to a double-fire mode that is both easy and convenient to be attached to the trigger.

A third objective of the present invention is to provide an attachment device and method for converting semi-automatic firearms to a double-fire mode that is easy to operate and control properly.

A fourth objective of the present invention is to provide an attachment device and method for converting semi-automatic firearms to a double-fire mode that would be more reliable than devices that convert to automatic firearms.

A fifth objective of the present invention is to provide an attachment device and method for converting semi-automatic firearms to a double-fire mode that can be conveniently attached within a short period of time.

A sixth objective of this invention is to provide an attachment device and method for converting semi-automatic firearms to double-fire mode that does not require taking apart, tampering or destroying the existing firearm device.

A seventh objective of the present invention is to provide an attachment device and method for converting semi-automatic firearms to a double-fire mode that can be easily removed so that the original semi-automatic firearm can still be operated.

An eighth objective of the present invention is to provide an attachment device and method of converting a firearm to a double-fire mode for use by civilians and consumers, that is not an automatic firearm that is restricted to law enforcement.

The novel invention allows for a double-fire mode where a firearm fires upon a single pull of a trigger, and fires again upon a single release of the trigger.

The novel trigger attachment device and method allows for various rates of fire other than the available semi-automatic and automatic rates of current firearms. The invention provides a simple, reliable attachment which can be quickly and easily attached to the semi-automatic firearm for increasing the firing rate up to a double-fire mode without causing automatic firing of the semi-automatic firearm.

The attachment causes the firearm to fire upon release of the trigger by separating the foot of the safety sear from the top of the trigger plate rotating the safety sear rearward on its pivot point which causes an increased gap between the trigger sear, at its hammer engaging notch, and the safety sear, at its hammer engaging notch allowing the hammer to pass through this increased gap upon release of the trigger.

The attachment can be constructed from a single component shaped to fit and mount onto the trigger with two tab-like features on either side that bend around to the backside of the trigger to maintain the attachments position on the trigger, and an extended length following the concave contour of the trigger upward where it is bent horizontally along the top surface of the trigger plate and under the bottom of the foot of the safety-sear separating the foot of the safety-sear from the top surface of the trigger plate causing an increased distance between the hammer engaging notch of the safety-sear and the hammer engaging notch of the trigger-sear due to the pivot point and rearward rotation of the safety-sear relative to the trigger-sear. The increased distance between the hammer engaging notch of the safety-sear and the hammer engaging notch of the trigger sear will not be extreme enough to prevent the safety-sear from engaging and retaining the hammer when the trigger is pulled and held, firing and cycling the firearm, yet will be sufficient enough to prevent the hammer engaging notch of the trigger-sear from engaging the hammer when the trigger is released therefore allowing the hammer to pass through and on to the firing pin into the firing position firing and cycling the firearm upon release of the trigger.

Another embodiment has the pivotal safety sear of the trigger assembly pre-built and/or preshaped and/or preformed with a footer so that the space between the upper right and left hammer catch notches is enlarged.

Further objects and advantages of this invention will be apparent from the following detailed description of the presently preferred embodiments which are illustrated schematically in the accompanying drawings.

BRIEF DESCRIPTION OF THE FIGURES

FIG. 2 is a front view of the double fire spacer of FIG. 1 along arrow 2A.

FIG. 3 is a top view of the double fire spacer of FIG. 1 along arrow 3A.

FIG. 4 is a side view of the double fire spacer of FIG. 4 along arrow 4A.

DESCRIPTION OF THE PREFERRED EMBODIMENTS

Before explaining the disclosed embodiments of the present invention in detail it is to be understood that the invention is not limited in its application to the details of the particular arrangement shown since the invention is capable of other embodiments. Also, the terminology used herein is for the purpose of description and not of limitation.

Figure 1:
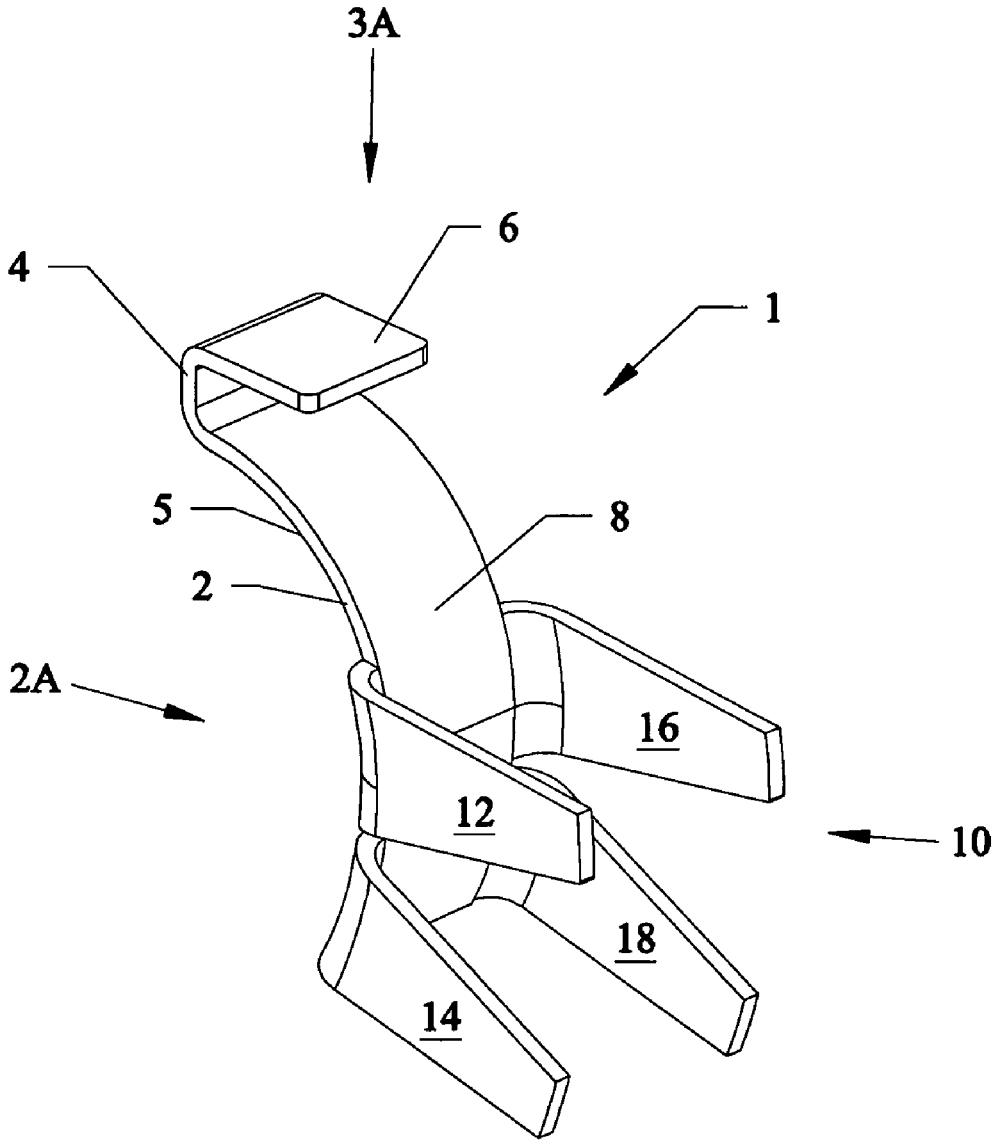
FIG. 1 shows a perspective view of a first preferred embodiment of a double fire spacer.

FIG. 1 shows a perspective view of a first preferred embodiment of a double fire spacer 1. FIG. 2 is a front view of the double fire spacer 1 of FIG. 1 along arrow 2A. FIG. 3 is a top view of the double fire spacer 1 of FIG. 1 along arrow 3A. FIG. 4 is a side view of the double fire spacer 1 of FIG. 4 along arrow 4A.

Referring to FIGS. 1–4, the double fire spacer 1 can be clip having a curved backing member 2 with bent portion 4 having an upper flange member 6. Extending from lower concave curved portion 8 of the backing member 2 can be clipping end 10 having four protruding bendable tab members 12, 14, 16, 18, with two tab members on to each side of the clip 1. The double fire spacer can be formed from a metal, such as but not limited to cold roll steel, stainless steel, galvanized metal, and the like.

Figure 5:
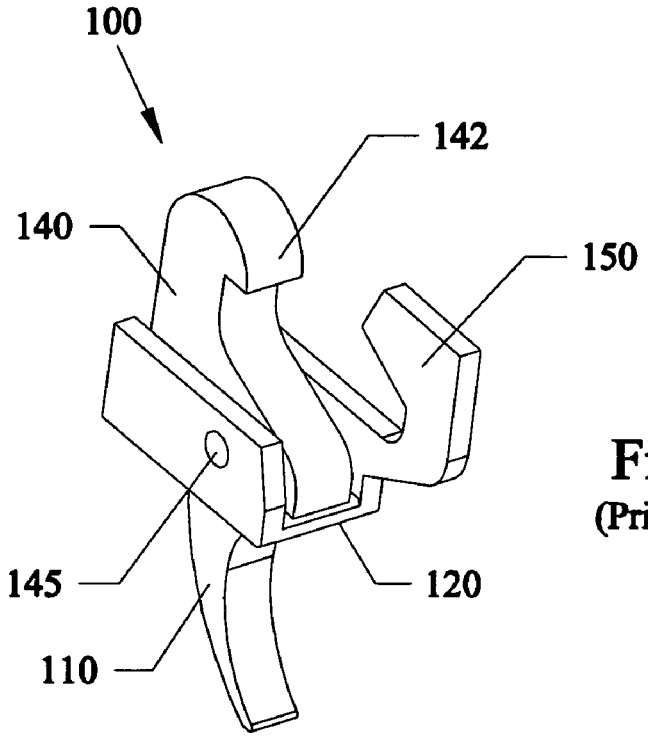
Fig.5 (Prior Art)
FIG. 5 is a perspective view of a prior art type weapon trigger assembly.
Figure 7:
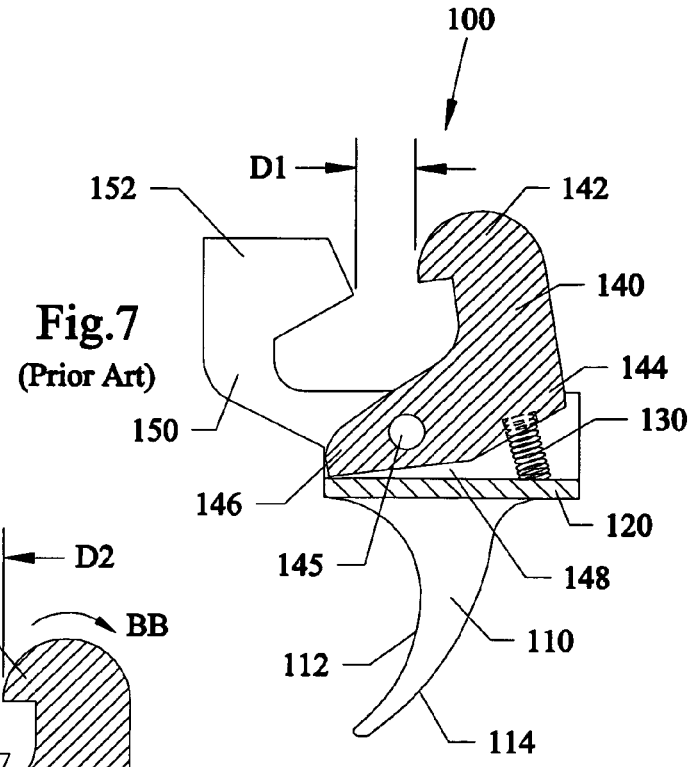
Fig.7 (Prior Art)
FIG. 7 is a side cross-sectional view of the trigger assembly of FIG. 5.

FIG. 5 is a perspective view of a prior art type weapon trigger assembly 100. FIG. 7 is a side cross-sectional view of the trigger assembly 100 of FIG. 5. The prior art type weapon trigger assembly 100 is of the type used in semi-automatic firearms, such as AK type firearms, such as but not limited to AK-47 rifles, and the like, that can include trigger 110 having concave curved surface 112 that engages a finger of a user and opposite convex curved surface 114. Along a top portion of the trigger 110 can be a mounting plate 120, with a J-shaped trigger sear plate 150 vertically extending up and fixably attached along one side of the mounting plate 120. The J-shaped trigger sear plate has a fixed located primary hammer latch portion 152 (a left upper hammer engage notch). Pivotally attached to a side wall portion of the trigger sear plate 150 at pivot point 145 can be a J-shaped safety sear plate 140 having secondary hammer latch portion 142 (a right upper hammer engage notch).

Referring to FIGS. 5 and 7 prior art trigger assembly 100 can include a secondary latch return spring 130 that rests in an expanded open condition can be attached to a rear bottom portion 144 of safety sear plate safety sear plate 140 and to the mounting plate 120. The front bottom portion 146 of the safety sear plate 140 forms a stop point when resting on the mounting plate 120 which sets the resting window opening space at a distance D1 between upper right hammer engage notch 142 and the upper left hammer engage notch 152.

Figure 6:
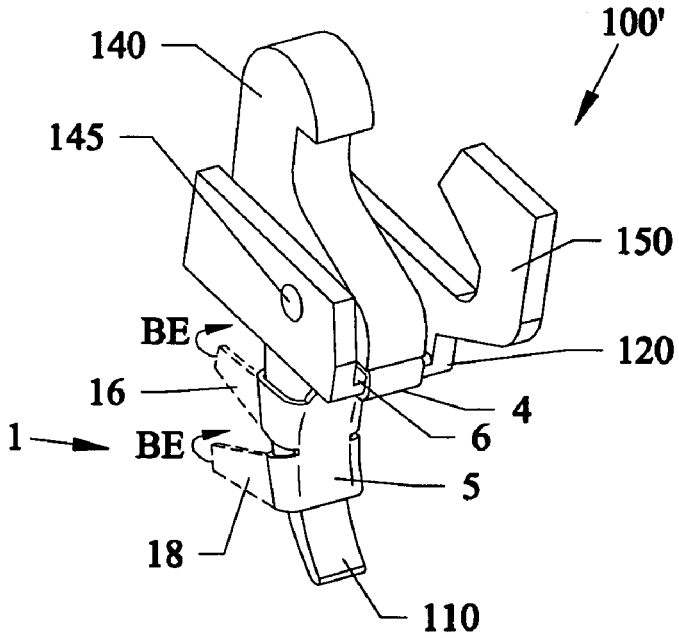
FIG. 6 is a perspective view of the trigger assembly of FIG. 5 with the double fire spacer.
Figure 8:
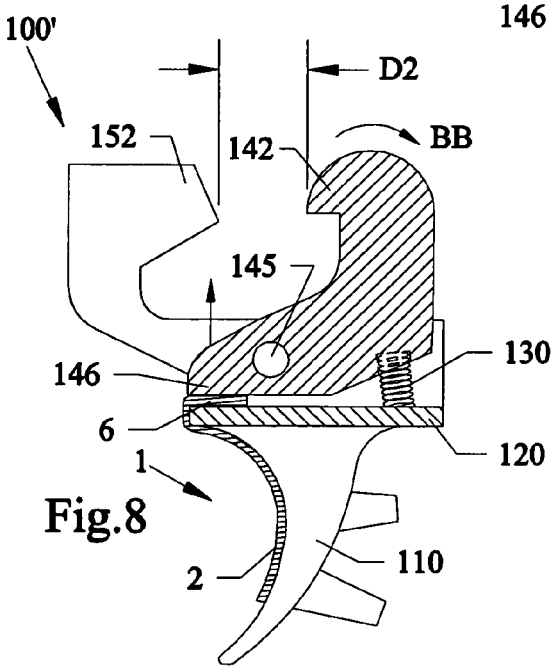
FIG. 8 is a side cross-sectional view of the trigger assembly of FIG. 7 with the double fire spacer.

FIG. 6 is a perspective view of the trigger assembly 100 of FIG. 5 with the double fire spacer 1 in an assembled view 100'. FIG. 8 is a side cross-sectional view of the trigger assembly 100 of FIG. 7 with the double fire spacer 1 in the assembled view 100'. The double fire spacer 1 can clip onto the assembly 100 having the curved portion 8 of backing member 2 to abut against the concave curved finger pulling surface 112 of the trigger 110 with ends of the tab members 12, 14, 16, 18 bent in the direction of arrow BE about the convex curved surface 114 of the trigger 110. When attached the upper flange member 6 of the spacer 1 rests on top of an edge surface of the mounting plate 120 raising the front bottom portion 146 of the safety sear plate 140 and pivotally moving back the upper right hammer engage notch 142 of the safety sear plate 140 in the direction of arrow BB. The flange member 6 effectively increases the resting window opening space to a distance D2 (where D2 is greater than D1) between the upper right hammer engage notch 142 and the upper left hammer engage notch 152.

FIGS. 9, 10, 11, 12, 13, 14, 15 and 16 show the various positions of components of the prior art trigger assembly of FIGS. 5 and 7 during a normal firing sequence. The normal firing sequence of the trigger assembly will now be described.

Figure 9:
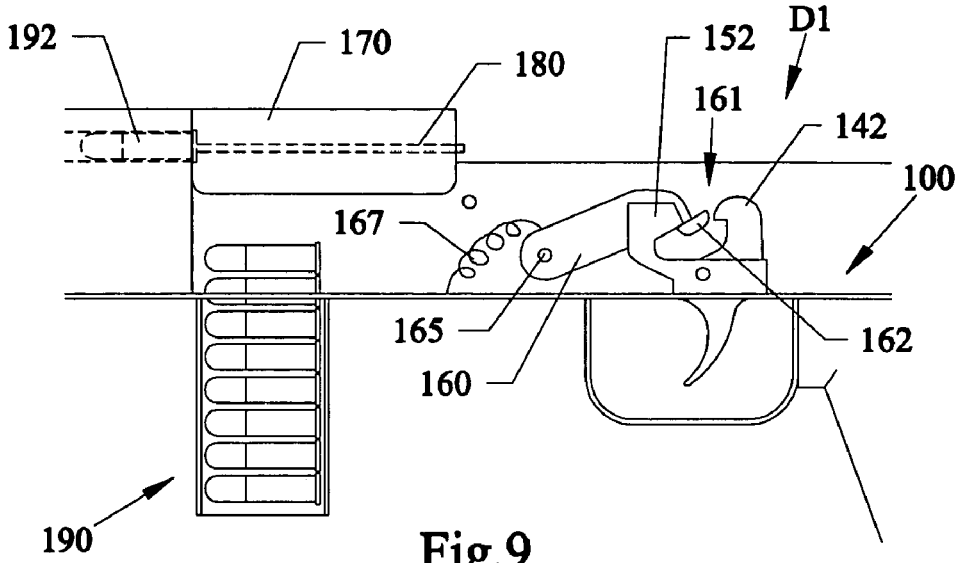
Fig.9 (Prior Art)
FIGS. 9, 10, 11, 12, 13, 14, 15 and 16 show the various positions of components of the prior art trigger assembly of FIGS. 5 and 7 during a firing sequence.

FIG. 9 is a side view of the trigger assembly 100 in the firearm, such as a semi-automatic rifle in a ready to fire position with a hammer head 161 on a pivotal hammer 160 located in space D1 between primary hammer latch 152 and secondary hammer latch 142. In this view an ammo clip 190 is positioned within the firearm below a spring loaded slide 170 having a firing pin 180 therethrough, and a round 192 (bullet) located in a chamber of the firearm.

Figure 10:
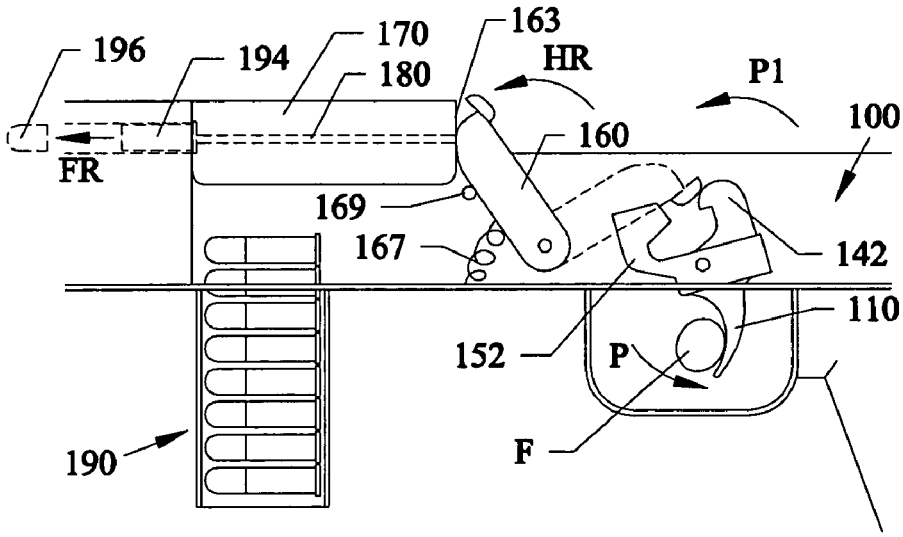
Fig.10 (Prior Art)

FIG. 10 is a next sequence view of FIG. 9 showing the trigger 110 depressed by a finger F in the direction of arrow P, the hammer 160 released and being pulled by coil spring 167 so that a surface portion 163 engages and end of the firing pin 180 causing an opposite end to strike the bullet 192 in the chamber, and a round detonated so that a slug 196 exits the firearm chamber in the direction of arrow FR leaving behind a shell 194. A stop 169 prevents the hammer that pivots from point 165 from traveling further than necessary to strike the firing pin 180. Here, the trigger assembly 100 rotates in the direction of arrow P1 forward allowing the hammer head 161 to be released from the primary hammer head latch portion 152.

Figure 11:
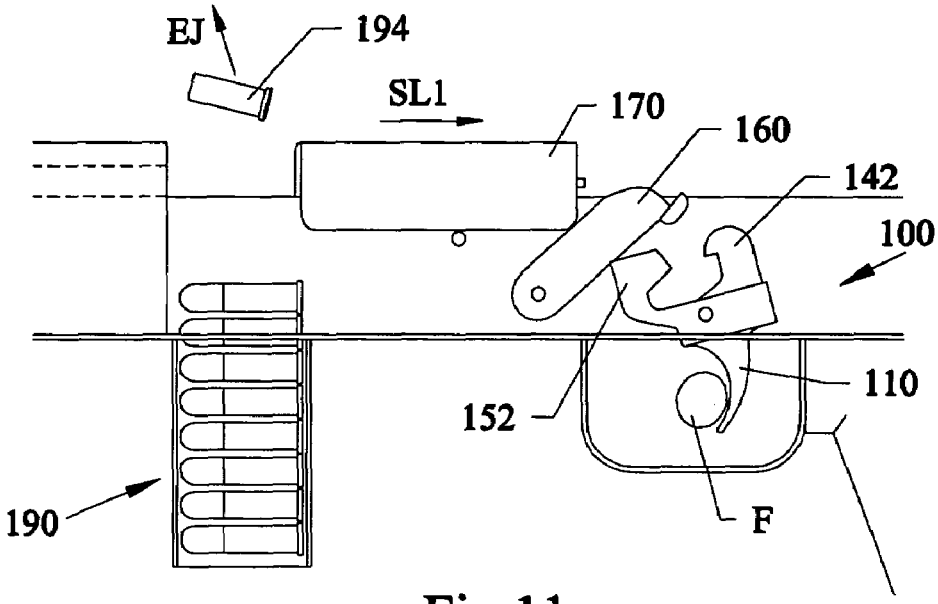
Fig.11 (Prior Art)

FIG. 11 is a next sequence view of FIG. 10 showing the trigger 110 still being held, the slide 170 propelled back in the direction of arrow SL1 by detonation, which moves the hammer 160 back and the shell 194 ejecting from the firearm chamber.

Figure 12:
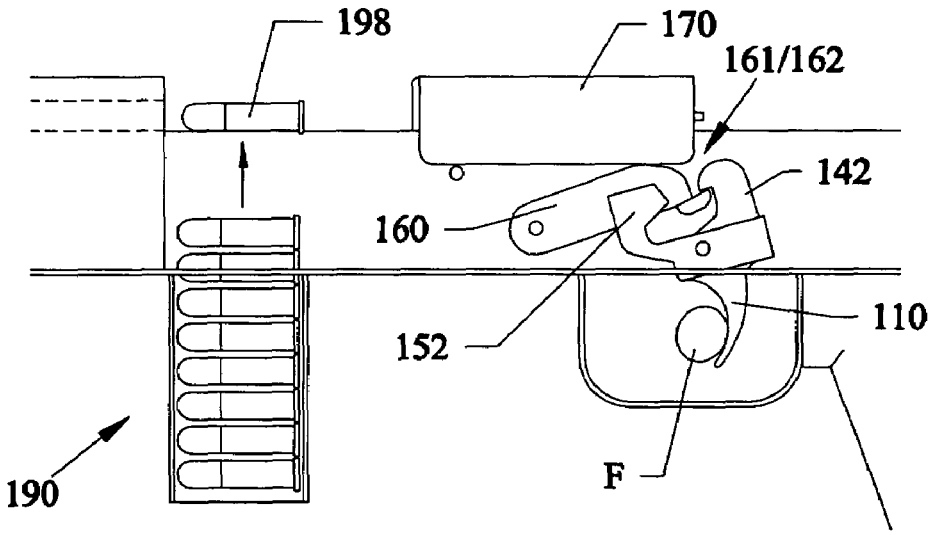
Fig.12 (Prior Art)

FIG. 12 is a next sequence view of FIG. 11 showing the trigger 110 still being held back by the finger F, the hammer head 161, 162 now caught by the secondary latch 142, and a new round 198 being moved into a loading position. The secondary latch 142 catches an edge 162 of the hammer head 161 keeping the hammer 160 from cycling back while the finger F is still in the pulled back position.

Figure 13:
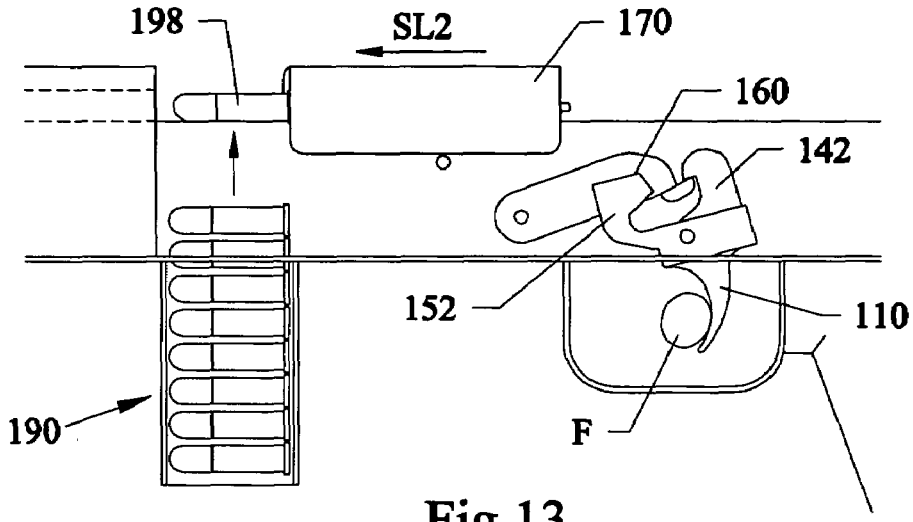
Fig.13 (Prior Art)

FIG. 13 is a next sequence view of FIG. 12 showing the trigger 110 still being held and the slide 170 returning back to the initial position in the direction of arrow SL2 based on being spring biased.

Figure 14:
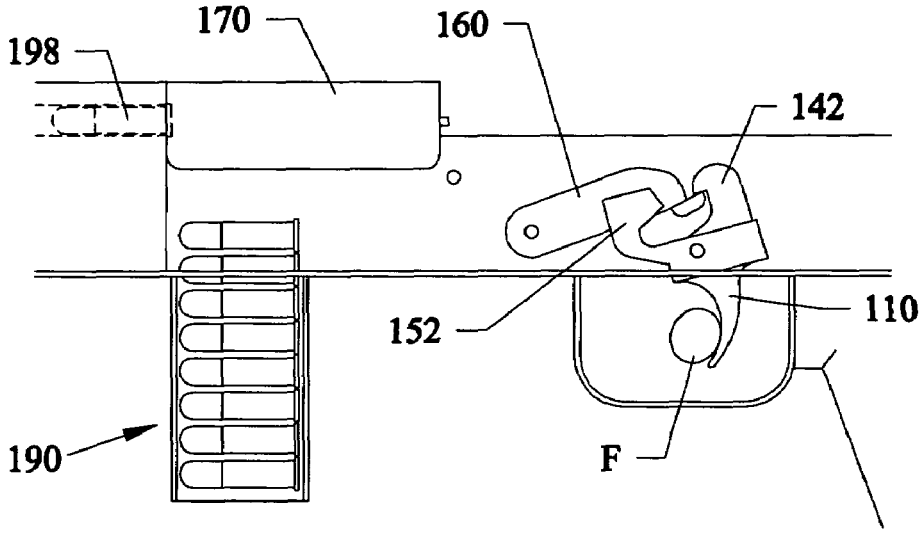
Fig.14 (Prior Art)

FIG. 14 is a next sequence view of FIG. 13 showing the trigger 110 still being held and the slide 170 having returned to the fire position having moved the new round 198 to a ready to fire position.

Figure 15:
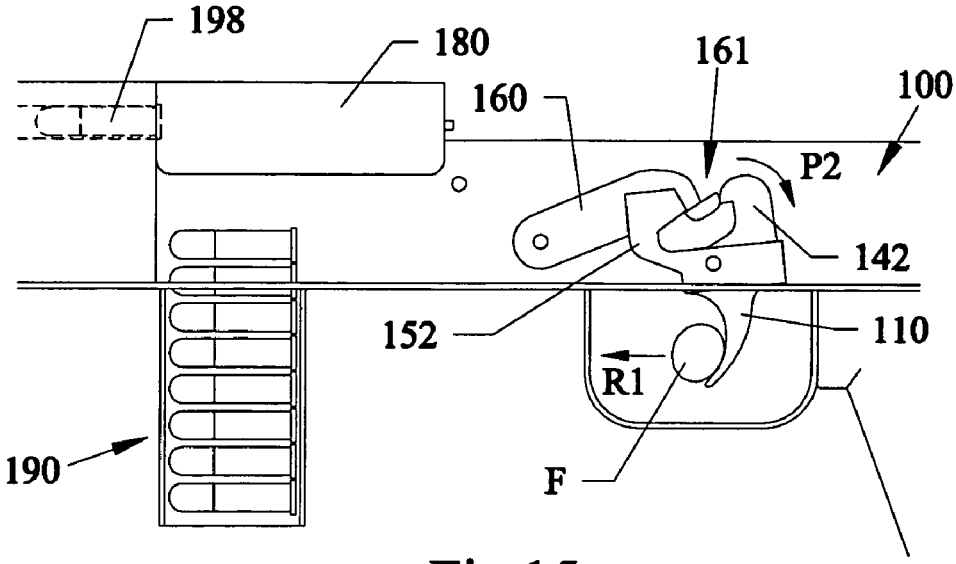
Fig.15 (Prior Art)

FIG. 15 is a next sequence view of FIG. 14 showing the trigger 110 being released by the finger moving away in the direction of arrow RI, where the edges 162 on the hammer head 161 slips from the secondary latch 142 and is caught by the primary latch 152. Here, the trigger assembly 100 rotates backward in the direction of arrow P2 (opposite the direction P1 shown in FIG. 10).

Figure 16:
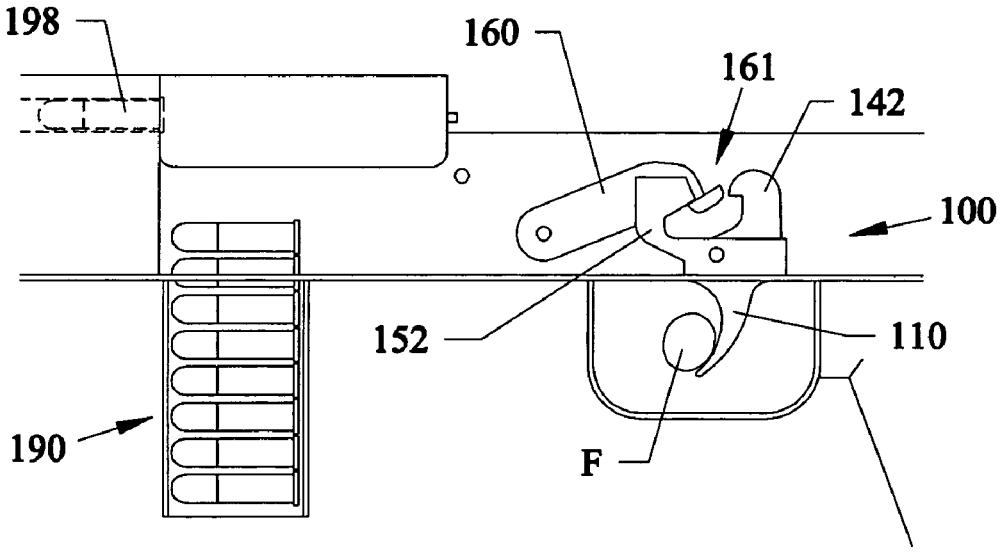
Fig.16 (Prior Art)

FIG. 16 is a next sequence view of FIG. 15 showing the trigger assembly 100 in a ready to fire position similar to that previously shown in FIG. 9.

During the sequence views of FIGS. 9–16, the firearm fires a single shot from the result of a single action of pulling the trigger 110 back once and allowing the trigger 110 to return to the ready to fire position.

FIGS. 17, 18, 19, 20, 21, 22, 23 and 24 show the various positions of the components of the trigger assembly 100 of the prior art modified with the novel double fire spacer 1 of FIGS. 1–4, 6 and 8 during a firing sequence.

Figure 17:
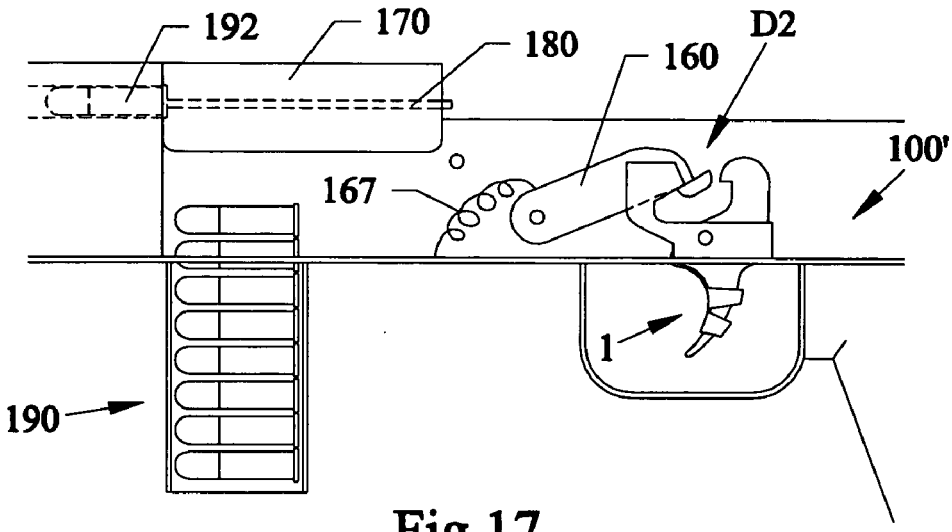
FIGS. 17, 18, 19, 20, 21, 22, 23 and 24 show the various positions of the components of a trigger assembly with the novel double fire spacer of FIGS. 1–4, 6 and 8 during a firing sequence.

FIG. 17 is another view of FIG. 9 showing a side view of the modified trigger assembly 100' with the novel double fire spacer 1 attached to thereto with the firearm in a ready to fire position. As shown the space D2 between the secondary hammer latch portion 142 and the primary hammer latch portion 152 is larger than the space D1 shown in FIG. 9 without the novel spacer 1. For example, a firearm having a space D1 being approximately 4/10 of an inch wide, can be increased by the clip spacer 1. For example, a flange member 6 having a thickness of approximately 1/16 of an inch thick can increase the space opening D1 from approximately 4/10 of an inch to a larger space opening D2 having a width of approximately 9/20 of an inch. As previously described in reference to FIGS. 6 and 8, the flange member 6 of the novel spacer 1 effectively increases the resting window opening space to a distance D2 (where D2 is greater than D1) between the upper right hammer engage notch 142 and the upper left hammer engage notch 152.

Figure 18:
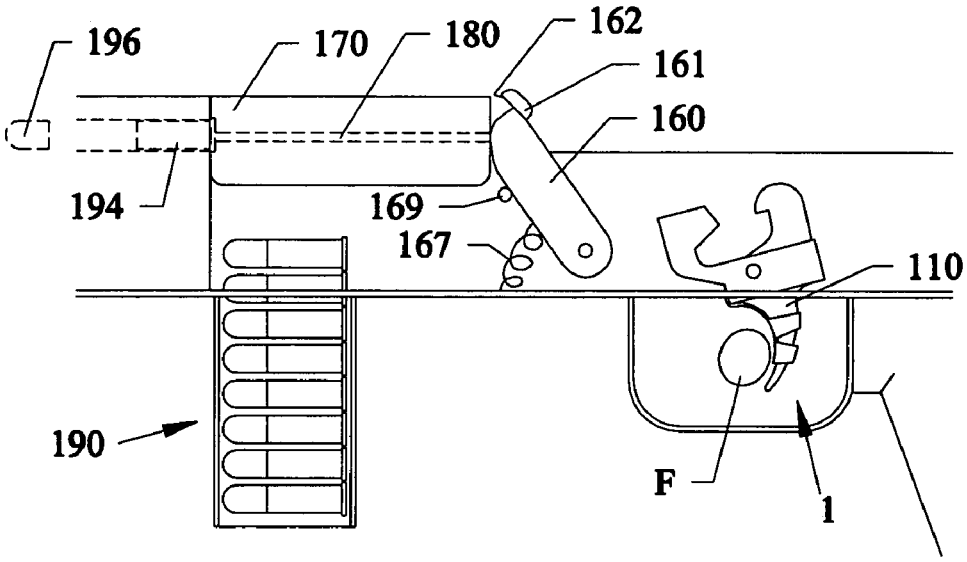

FIG. 18 is a next sequence view of FIG. 17 showing the trigger 110 depressed by finger F, the hammer 160 released and the round detonated by the firing pin in the slider 170 so that a slug 196 leaves a shell 194 behind, functioning similar to FIG. 10.

Figure 19:
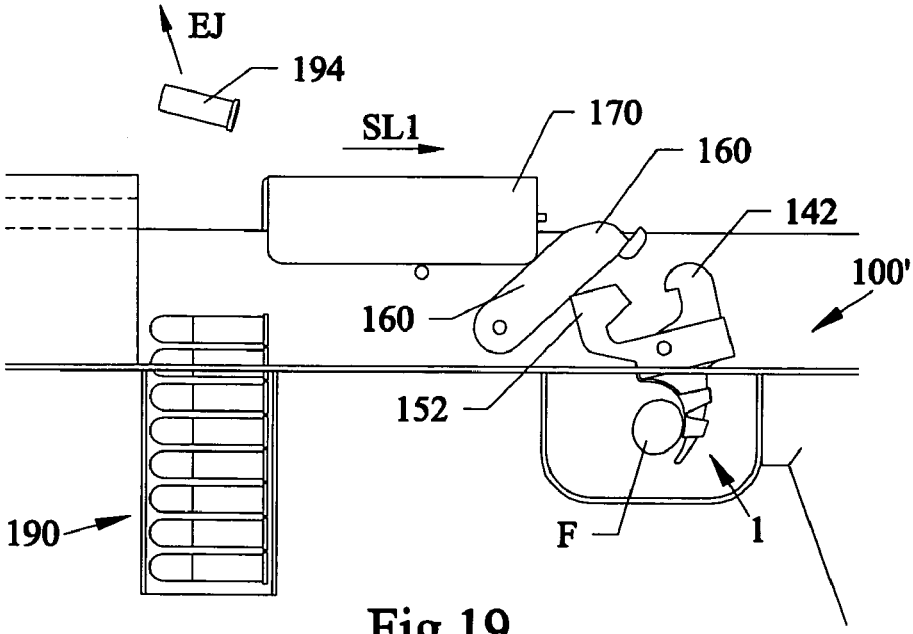

FIG. 19 is a next sequence view of FIG. 18 showing the trigger 110 in the modified trigger assembly 100' still being held, the slide 170 propelled back in the direction by arrow SL1 by the firing detonation, and the hammer 160 moving back, and the shell 194 ejecting out similar to FIG. 11.

Figure 20:
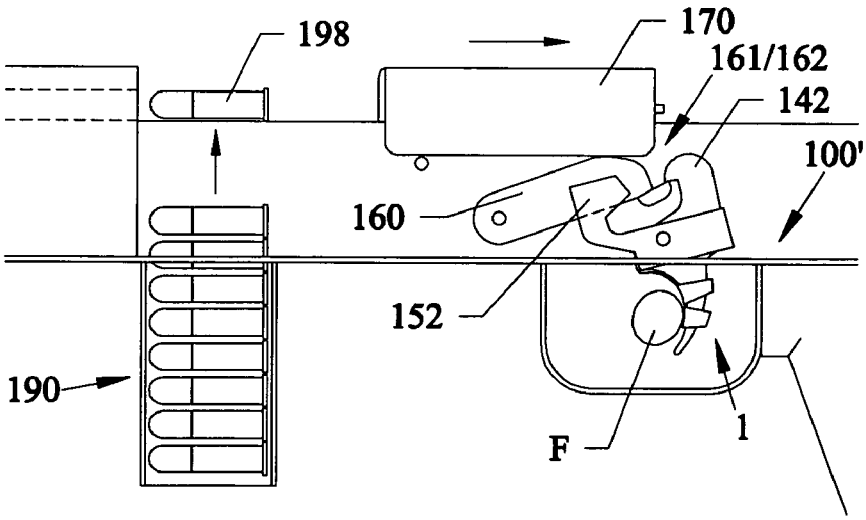

FIG. 20 is a next sequence view of FIG. 19 showing the trigger 110 still being held back, the head 161 of the hammer 160 caught by secondary latch 142, and a new round moved into a loading position similar to that of FIG. 12.

Figure 21:
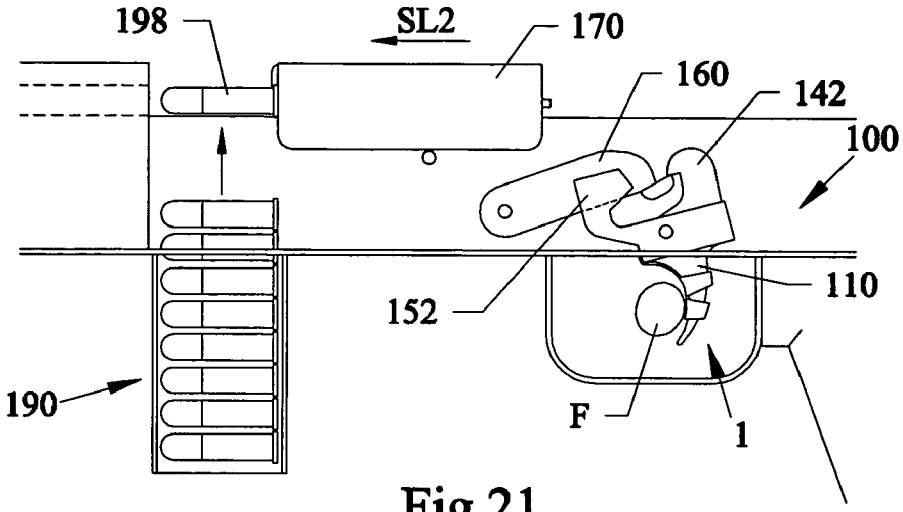

FIG. 21 is a next sequence view of FIG. 20 showing the trigger 110 held, spring biased slide 170 returning in the direction of arrow SL2 to a fire position similar to that shown in FIG. 13.

Figure 22:
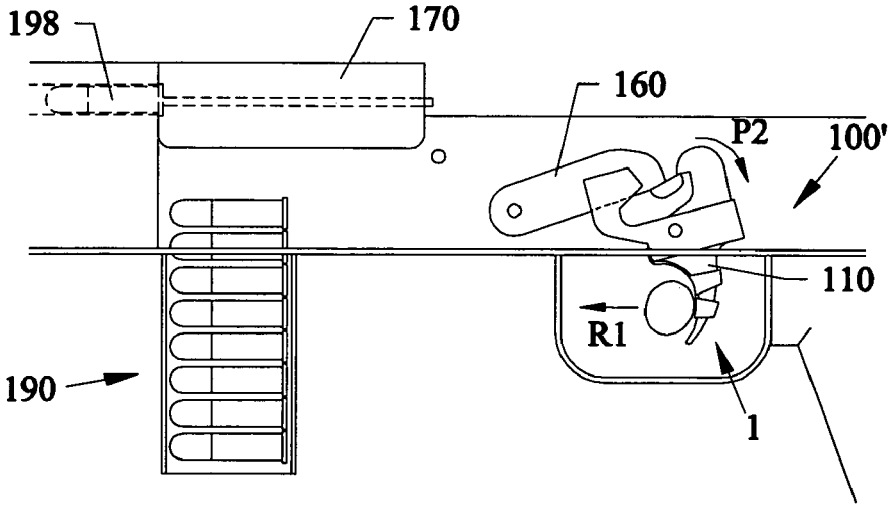

FIG. 22 is a next sequence view of FIG. 21 showing the trigger held back and the slide 170 returned. At this point the function of the components in the trigger assembly 100' starts the novel double fire mode in the firearm.

Figure 23:
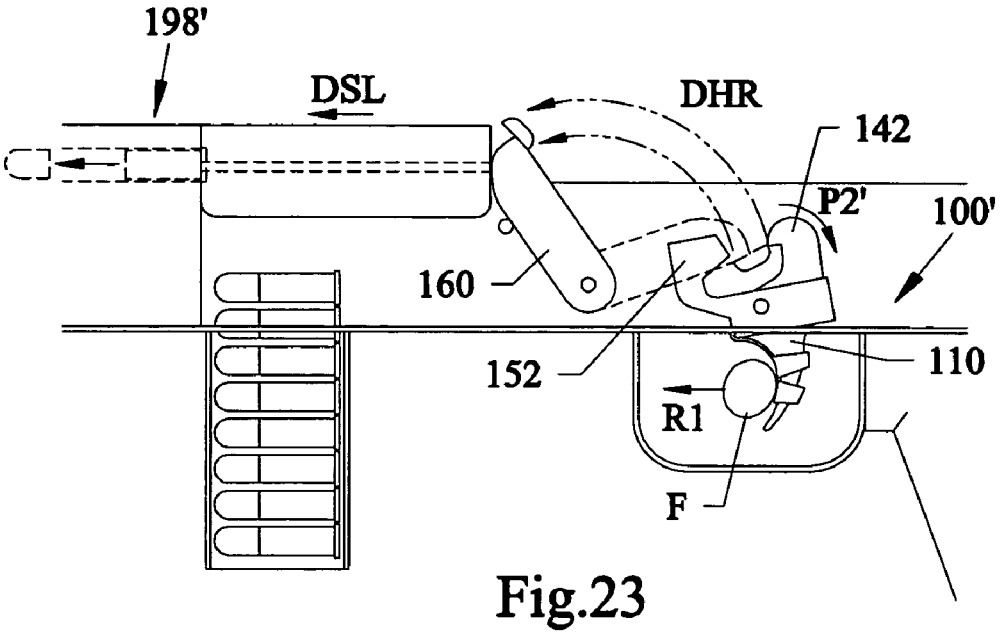

FIG. 23 is a next sequence view of FIG. 22 showing the trigger 110 releasing, and the hammer head 161, 162 slipping prematurely from the secondary latch 142 (because of the enlarged space D2), causing the hammer to rotate in the direction of arrow DHR hitting the firing pin 180 moving the slider 170 against the next round 198'. Unlike, the prior art sequence view shown in FIG. 15, the enlarged space D2 causes the hammer head to slip and NOT be caught by the primary hammer latch portion 152 (the left upper engage notch). The modified trigger assembly 100' causes a double fire mode (two shots in sequence) by a single trigger pull and release action. Immediately after the double fire shot, the slider 170 is caused to move back moving the hammer 160 back (similar to that shown in FIGS. 11, 12, 19, 20. The slide 170 will cycle through loading sequence again. The invention allows for a quick double fire action by a single trigger pull and release action.

Figure 24:
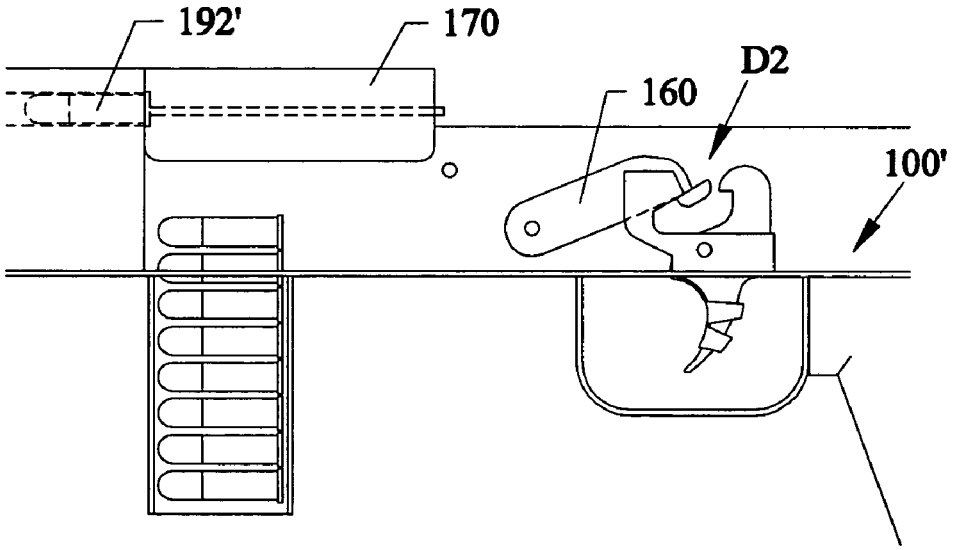

FIG. 24 shows the final sequence of the double fire mode showing the trigger 110 released, the slide 170 cycled, and the firearm in a ready to fire position, and the firearm components in positions similar to that shown in FIG. 17.

Figure 25:
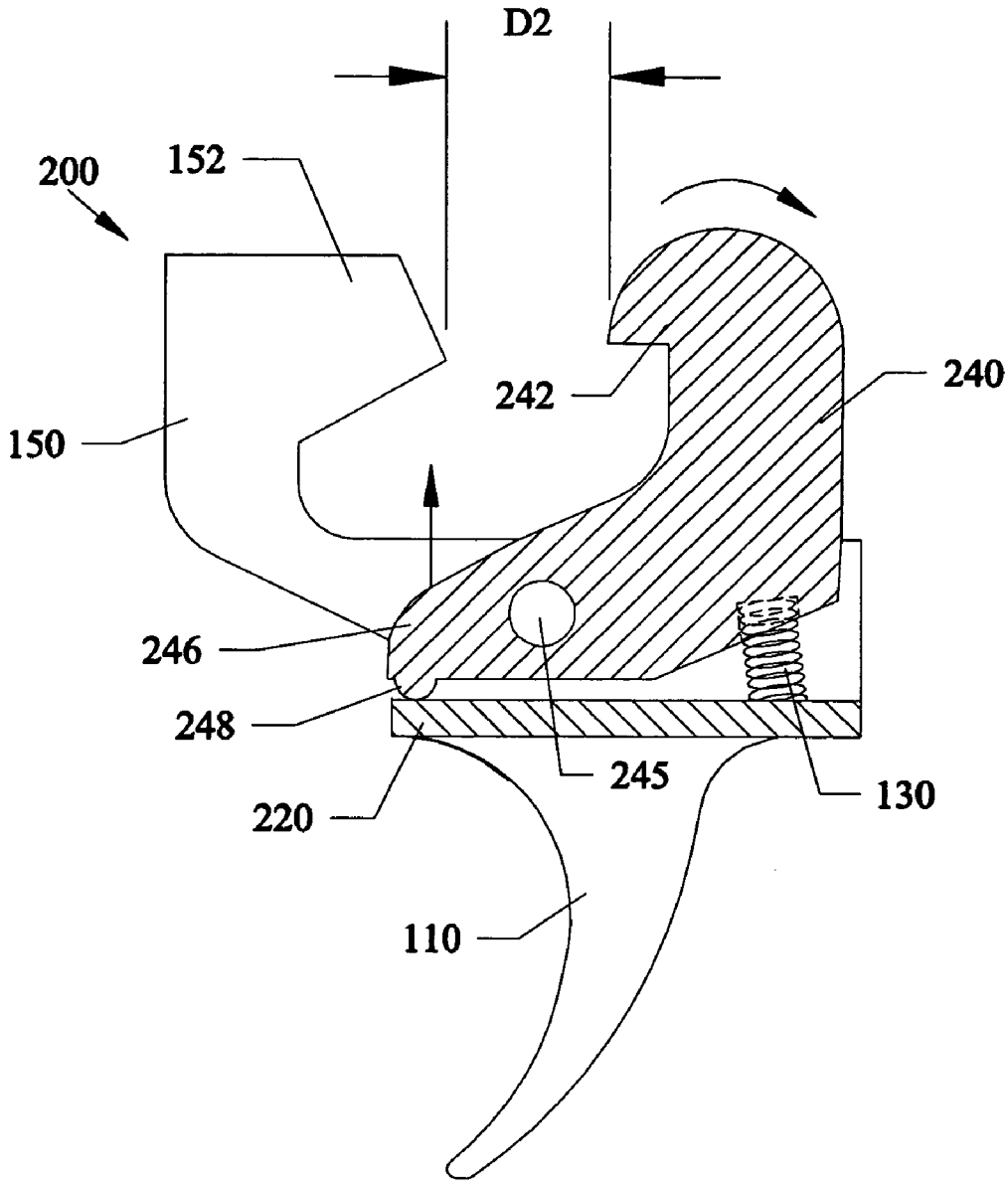
FIG. 25 is a side cross-sectional view of the trigger assembly of FIG. 7 with a built in spacer.

FIG. 25 is a side cross-sectional view of another embodiment 200 having the trigger assembly 100 of FIG. 7 with a built in spacer to affect the enlarged window space opening D2. Here, the trigger assembly 200 has a trigger 110, mounting plate 120, trigger sear plate 150 with primary hammer latch portion 152, and modified pivotal safety sear plate 140 having secondary hammer latch portion 142, front bottom 146, and a pre-formed (for example pre-molded, and the like) downwardly protruding footer spacer 248, which effects the enlarged window space opening D2. The secondary embodiment 200 can function similar to the clip spacer 1 previously described, and effect a double fire mode action every time a trigger is pulled once.

The invention can include additional features as desired, such as but not limited to a resilient pad surface that can be added to the curved external finger engaging surface of the clip spacer 1 for comfort and enhanced gripping action by the user.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An attachment device for increasing the firing rate of a semi-automatic firearm having a pullable trigger beneath a mounting plate, and a moveable hammer, a pivotal safety sear with an upper hammer engage notch, and a trigger sear with an upper hammer engage notch above the mounting plate, comprising:

a separator member for being positioned between a portion of the safety sear and a portion of the mounting plate for causing the hammer engage notch of the safety sear to pivot away from the hammer engage notch of the trigger sear; and a clip being fixably attached to the separator member for being attached to the trigger, so that pulling and releasing the trigger increases the firing rate of the semi-automatic firearm.

2. The attachment device of claim 1, wherein the separate member and the clip are formed from a single piece of metal.

3. The attachment device of claim 1, wherein the clip includes:

a back portion having a concave shape to abut against a concave side of the trigger.

4. The attachment device of claim 1, wherein the clip includes:

tabs for being bent about the trigger.

5. The attachment device of claim 3, wherein the tabs include:

two tabs, each tab on opposite sides of the trigger.

6. The attachment device of claim 3, wherein the tabs include:

two left tabs bent about a left side of the trigger; and two right tabs bent about a right side of the trigger.

7. A method of causing a semi-automatic firearm to a double fire mode during a single firing sequence, the firearm having a pullable trigger beneath a mounting plate, and a moveable hammer, a pivotal safety sear with an upper hammer engage notch, and a trigger sear with an upper hammer engage notch above the mounting plate, comprising the steps of:

increasing space between the upper hammer engage notch of the safety sear and the upper hammer engage notch of the trigger sear; and pulling the trigger; and causing a double firing from the fire arm during the pulling and subsequent releasing of the trigger.

8. The method of claim 7, further comprising the step of:

clamping a mount about the trigger of the firearm to increase the space between the upper hammer engage notch of the safety sear and the upper hammer engage notch of the trigger sear.

9. The method of claim 8, wherein the clamping step includes the step of:

bending tabs on a clip about the trigger.

10. The method of claim 8, wherein the increasing space step includes the step of:

pivoting the safety sear so that the upper hammer engage notch of the safety sear moves away from the upper hammer engage notch of the trigger sear.

11. The method of claim 8, wherein the increasing space step includes the step of:

positioning a separator member between the mounting plate and a bottom portion of the pivotable safety sear.

12. The method of claim 8, further comprising the step of:

providing a single component for both the clamping and increasing steps.

13. The method of claim 7, further comprising the step of:

providing the safety sear with a downwardly protruding foot member to increase the space between the upper hammer engage notch of the safety sear and the upper hammer engage notch of the trigger sear.

14. The method of claim 13, wherein the providing step includes the step of:

pre-shaping the safety sear with the downwardly protruding foot member.

15. An improved pivotal safety sear device for increasing the firing rate of a semi-automatic firearm to a double fire mode, where the firearm has a pullable trigger beneath a mounting plate, and a moveable hammer, the pivotal safety sear device having an upper hammer engage notch, and a trigger sear with an upper hammer engage notch above the mounting plate, the pivotal safety sear device comprising:

an enlarged foot member for being positioned between a bottom portion of the pivotable safety sear device to one side of a pivot point and a portion of the mounting plate for causing the hammer engage notch of the safety sear device to pivot away from the hammer engage notch of the trigger sear, so that a single sequence of pulling and releasing the trigger causes the semi-automatic firearm to fire twice during the single pulling and releasing sequence.

16. The improved pivotal safety sear device of claim 15, wherein the enlarged foot member includes:

a downwardly protruding foot member portion to increase the space between the upper hammer engage notch of the safety sear device and the upper hammer engage notch of the trigger sear.

17. The improved pivotal safety sear device of claim 16, wherein the downwardly protruding foot member portion is a pre-shaped part of the safety sear device.

18. The improved pivotal safety sear device of claim 15, further comprising:

a clip being fixably attached to the pullable trigger, the clip having a portion which forms the enlarged foot member that is positioned between the bottom portion of the pivotable safety sear device and the portion of the mounting plate.

19. The improved pivotal safety sear device of claim 18, the clip having at least two opposing tabs for attaching the clip to the trigger.

* * * * *